US006250902B1

(12) United States Patent
Dwiggins et al.

(10) Patent No.: US 6,250,902 B1
(45) Date of Patent: Jun. 26, 2001

(54) EMBOSSING ROLL CLEANING APPARATUS

(75) Inventors: John H. Dwiggins, Neenah; Orlin C. Kuehl, Kimberly; Michael S. Heath, Menasha; Brian J. Schuh, Appleton; James C. Hornby, Kaukauna; Galyn A. Schulz, Greenville, all of WI (US); Rodney E. Pollock, Camas, WA (US)

(73) Assignee: Fort James Corporation, Neenah, WI (US)

( * ) Notice: Subject to any disclaimer, the term of this patent is extended or adjusted under 35 U.S.C. 154(b) by 0 days.

(21) Appl. No.: 09/334,944

(22) Filed: Jun. 17, 1999

Related U.S. Application Data

(62) Division of application No. 08/970,504, filed on Nov. 14, 1997, now Pat. No. 6,093,256.

(51) Int. Cl.[7] ..... B28B 11/22

(52) U.S. Cl. ..... 425/101; 134/153; 15/309.1; 15/316.1; 425/230

(58) Field of Search ..... 425/225, 227, 425/230, 101; 15/306.1, 309.1, 316.1; 134/153

(56) References Cited

U.S. PATENT DOCUMENTS

| | | | | |
|---|---|---|---|---|
| 3,502,757 | * | 3/1970 | Spencer | 264/556 |
| 3,525,116 | | 8/1970 | Shaffer | 15/309.1 |
| 3,628,996 | | 12/1971 | Weber | 427/387 |
| 3,660,200 | * | 5/1972 | Anderson et al. | 156/306 |
| 3,965,518 | | 6/1976 | Muoio | 15/104.93 |
| 4,003,784 | | 1/1977 | Heim et al. | 162/199 |
| 4,077,853 | * | 3/1978 | Coll-Palagos | 204/20 |
| 4,425,458 | | 1/1984 | Lindner et al. | 524/314 |
| 4,591,485 | | 5/1986 | Olsen et al. | 422/20 |
| 4,594,748 | | 6/1986 | Warfvinge | 15/308 |
| 4,633,567 | * | 1/1987 | Montalbano | 29/445 |
| 4,643,775 | | 2/1987 | Reba et al. | 134/15 |
| 4,767,815 | | 8/1988 | O'Lenick, Jr. | 524/317 |
| 4,783,947 | | 11/1988 | Posey et al. | 53/167 |
| 4,839,227 | * | 6/1989 | Hoopman | 428/343 |
| 4,852,209 | | 8/1989 | Svenka et al. | 15/308 |
| 4,862,799 | * | 9/1989 | Hycner et al. | 101/348 |
| 4,868,236 | | 9/1989 | O'Lenick, Jr. | 524/308 |
| 5,059,282 | | 10/1991 | Ampulski et al. | 162/111 |
| 5,139,616 | | 8/1992 | Ling | 162/147 |
| 5,164,046 | | 11/1992 | Ampulski et al. | 162/111 |
| 5,300,942 | * | 4/1994 | Dolgoff | 345/32 |
| 5,304,254 | | 4/1994 | Chino et al. | 134/37 |
| 5,312,968 | | 5/1994 | O'Lenick, Jr. et al. | 560/182 |
| 5,340,430 | | 8/1994 | Pfuhl | 156/344 |
| 5,466,298 | | 11/1995 | Pollock | 134/15 |
| 5,490,300 | | 2/1996 | Horn | 15/1.51 |
| 5,543,171 | | 8/1996 | Shores | 427/177 |
| 5,577,294 | | 11/1996 | Pollock | 15/345 |
| 5,603,775 | * | 2/1997 | Sjoberg | 134/21 |
| 5,614,062 | | 3/1997 | Schulte et al. | 162/175 |
| 5,629,387 | | 5/1997 | Frances et al. | 525/478 |
| 5,660,687 | | 8/1997 | Allen et al. | 162/111 |
| 6,024,801 | * | 2/2000 | Wallace et al. | 134/1 |

OTHER PUBLICATIONS

Tom W. Woodward, "A modern approach to recycled fibre contaminant control", *Paper Technology*, vol. 36, No. 7, Sep. 1995, pp. 27–32.

* cited by examiner

*Primary Examiner*—Robert Davis
*Assistant Examiner*—Joseph S. Del Sole
(74) *Attorney, Agent, or Firm*—Finnegan, Henderson, Farabow, Garrett & Dunner, L.L.P.

(57) ABSTRACT

An embossing roll cleaning apparatus is provided. The cleaning apparatus includes a nozzle having an air inlet and an elongated narrow outlet that extends an embossing width of the embossing roll. A source of compressed air is connected to the air inlet of the nozzle. The outlet of the nozzle directs the pressured air as an air knife against the surface of the embossing roll to dislodge deposits stuck to the surface of the embossing roll.

16 Claims, 2 Drawing Sheets

EMBOSSING ROLL CLEANING APPARATUS

This is a division of application Ser. No. 08/970,504, filed Nov. 14, 1997 and now U.S. Pat. No. 6,093,256 all of which are incorporated herein by reference.

FIELD OF THE INVENTION

The present invention relates generally to embossing. More particularly, it relates to a method and apparatus for cleaning and preventing build up of deposits on an embossing roll during an embossing process.

BACKGROUND OF THE INVENTION

The process of embossing is widely used in the production of consumer goods. Manufacturers use the embossing process to impart a texture or relief pattern into products made of textiles, paper, synthetic materials, plastic materials, metals, and wood. Embossing a product can enhance the visual perception or improve the performance of the product. For example, embossing a paper product can result in a visually pleasing pattern on the paper or in the increased bulk and absorbency of the product.

Embossing is the act of mechanically working a substrate to cause the substrate to conform under pressure to the depths and contours of a pattern engraved or otherwise formed on an embossing roll. Embossing is accomplished by passing a substrate, or web, through one or more patterned embossing rolls set to apply a certain pressure and penetration depth to the web. As the web passes the embossing rolls, the pattern on the rolls is imparted onto the web.

The patterns on the embossing rolls can be mated or non-mated. In a pair of mated embossing rolls, the pattern on one of the rolls compliments identically, or "mates," with the pattern on the other of the mated rolls. The pattern on a non-mated embossing roll does not match identically with the pattern on the other roll. Depending on the desired results, either type of embossing roll can be used.

A problem encountered during the embossing process is caused by the buildup of deposits on the embossing rolls. As the embossing roll works a web, fiber, stickies, and other deposits from the web stick to the surface of the embossing roll. The accumulation of deposits on the pattern on the embossing roll changes the depths and contours of the pattern that is imprinted into the web and impairs the embossing definition. Also, the unchecked accumulation of deposits might lead to vibrations in the embossing roll as it rotates with the web. This quick accumulation of deposits can damage or destroy a set of mated embossing rolls if the accumulated deposits are not removed from the rolls regularly. Thus, to ensure that the embossing process produces the desired results in a safe manner, the process must be stopped periodically to clean the deposits from the embossing rolls.

One approach to solving this problem is to attempt to clean loose fiber from the web before the web reaches the embossing roll. These types of web cleaning devices are widely described in the patent literature. A comprehensive, but non-exhaustive list includes U.S. Pat. Nos. 5,577,294; 5,490,300; 5,466,298; 5,304,254; 4,783,947; 4,643,775; and 4,594,748. However, these devices remove few, if any, stickies or pitch that is firmly embedded in the web. Furthermore, these inventions do not remove 100% of the loose fiber present.

Devices for cleaning deposits from embossing rolls, such as the device disclosed in U.S. Pat. No. 4,852,209, are very complicated and expensive. They usually require spraying water or solvent on the rolls and then removing the water or solvent. Usually there is some residual solvent which can itself lead to plugging of an emboss roll. Brush rolls are not an appropriate alternative because they do not remove firmly embedded deposits and the brush bristles fall off and end up in the product.

Another potential solution to the accumulation of deposits problem is to apply a lubricant solution to the surface of the embossing roll using spray nozzles. The lubricant prevents some fiber and sticky build up, by lubricating the surface of the embossing roll so that deposits do not attach to the surface.

However, using a spray nozzle to apply the lubricant or solvent solution creates additional problems. To cover the entire surface of the embossing rolls, the spray nozzles must usually be positioned 6 to 8 inches from the surface of the roll and 6 to 8 inches apart. With this positioning, the spray nozzles create a mist of lubricant around the embossing roll. Some of the mist stays in the air and the remainder settles on the embossing roll, the surrounding equipment, or on the floor, thereby wasting a significant amount of the sprayed material. The mist in the air creates a breathing hazard and the mist that settles on the floor creates other safety hazards. In addition to wasting the sprayed chemical and creating potential breathing and safety hazards, the mist leaves an uneven coating on the surface of the embossing roll. The uneven coating of lubricant is ineffective in preventing the accumulation of deposits because the surface areas having a thicker coating of lubricant actually trap the deposits. Also, the deposits stick to the areas of the embossing roll that do not get enough lubricant.

In light of the foregoing, there is a need for a device and a method by which the embossing rolls can be kept clean of deposits during the embossing process.

SUMMARY OF THE INVENTION

Accordingly, the present invention is directed to an apparatus and method for preventing the buildup of fiber on an embossing roll during the embossing process.

The advantages and purpose of the invention will be set forth in part in the description which follows, and in part will be obvious from the description, or may be learned by practice of the invention. The advantages and purpose of the invention will be realized and attained by the elements and combinations particularly pointed out in the appended claims.

To attain the advantages and in accordance with the purpose of the invention, as embodied and broadly described herein, the invention comprises a method of cleaning embossing rolls. The method involves directing pressured air at the surface of the embossing roll by an air nozzle that forms an air knife to dislodge deposits from the roll. A lubricant and/or solvent solution can be mixed with the air and sprayed along the width of the embossing roll.

The present invention also concerns a method of embossing a web, where the web is passed between a pair of embossing rolls to impart the pattern of the embossing rolls upon the web. Pressured air, with or without the lubricant, is then directed at the surface of the embossing roll to dislodge deposits from the roll. The present invention further concerns an embossed paper product made with the method of the present invention.

According to another aspect, the invention concerns an apparatus for preventing the accumulation of deposits on the surface of an embossing roll. The apparatus has an air nozzle and a source of pressured air. In another embodiment, the apparatus has a means for mixing a lubricant and/or solvent solution into the pressured air. The nozzle has an air inlet and an elongated narrow slit opening that extends for the width of the embossing roll. The compressed air source forces air through the nozzle forming an air knife that is directed onto the surface of the embossing roll. A lubricant and/or solvent solution can be mixed into the air supply of the air knife and sprayed onto the surface of the embossing roll to prevent the accumulation of deposits on the surface of the embossing roll.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DETAILED DESCRIPTION

Figure 1:
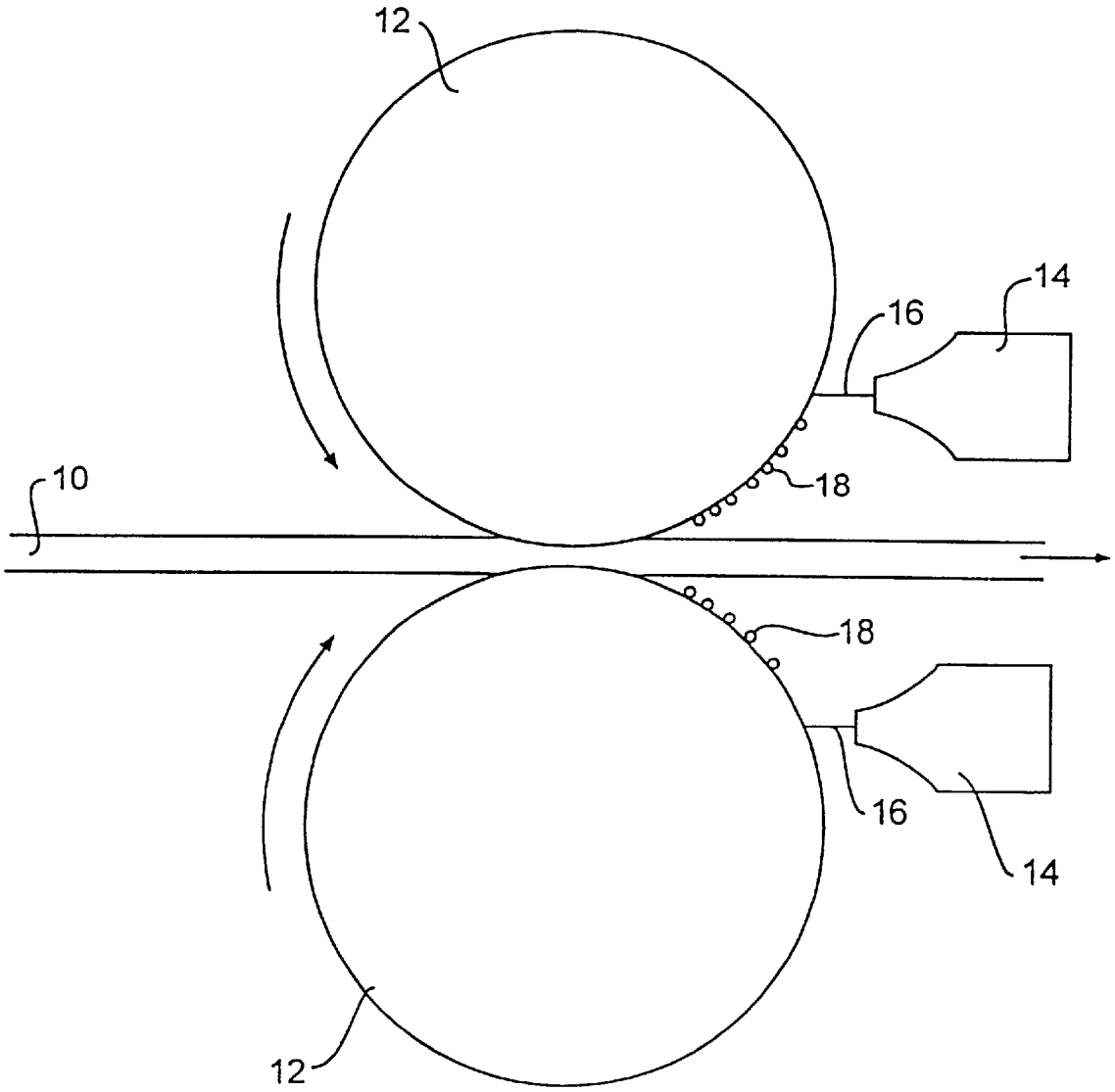
FIG. 1 is side view of a pair of embossing rolls incorporating the air nozzles of the present invention.

Reference will now be made in detail to the present preferred embodiment of the invention, an example of which is illustrated in the accompanying drawings. Wherever possible, the same reference numbers will be used throughout the drawings to refer to the same or like parts.

The present invention is directed to a method and apparatus for cleaning the surface of an embossing roll. More specifically, the present invention provides an air knife that dislodges deposits from the surface of an embossing roll. A lubricant and/or solvent solution may be mixed into the air supply of the air knife to help clean and lubricate the surface of the embossing roll or to prevent deposits from lodging to the surface of the embossing roll.

During a typical embossing process, a substrate, or web, is passed through an emboss configuration designed to impart a certain pattern onto the web. The present invention may be used with any art recognized emboss configuration such as embossing rolls with a relieved pattern or a relieved-pattern roll. Appropriate emboss configurations include dual or multi-roll and single or multi-nip embossing systems. The embossing configurations are preferably rigid-to-resilient or rigid-to-rigid systems.

In a rigid-to-resilient embossing system, the web is passed through the nip formed between a roll whose substantially rigid surface contains a multiplicity of protuberances and/or depressions arranged into an aesthetically-pleasing pattern and a second roll, whose substantially resilient surface can be either smooth or also contain a multiplicity of protuberances and/or depressions which cooperate with the rigid surfaced patterned roll. The rigid roll can be formed with a steel body and directly engraved upon or can contain a hard rubber-covered surface (directly coated or sleeved) upon which the embossing pattern is laser engraved. The resilient roll may consist of a steel core directly covered or sleeved with a resilient material such as rubber and either ground smooth or laser-engraved with either a mated or a non-mated pattern corresponding to the rigid roll.

In the rigid-to-rigid embossing process, the web is passed through the nip formed between two substantially rigid rolls. The surfaces of the rolls contain a multiplicity of protuberances and/or depressions arranged into an aesthetically-pleasing pattern where the protuberances and/or depressions in the second roll cooperate with the first rigid patterned roll. The first rigid roll can be formed with a steel body and directly engraved upon or can contain a hard rubber-covered surface (directly coated or sleeved) upon which the embossing pattern is laser-engraved. The second rigid roll can be formed with a steel body or can contain a hard rubber covered surface (directly coated or sleeved) upon which a matching or mated pattern is conventionally engraved or laser-engraved.

In any type of emboss configuration, the steel embossing rolls may be coated with any material recognized in the art as capable of reducing the possibility of loose deposits sticking to the surface of the embossing roll. In a preferred embodiment of the present invention, the steel rolls are coated with electroless nickel which is impregnated with a thermoplastic resin having non-stick characteristics, such as polytetrafluoroethylene, to fill the pores.

There are many different types of materials that may be embossed. The present invention may be used with any art recognized web material. Preferably, the present invention is used when embossing any type of web that contains loose elements which might stick to the surface of the embossing rolls. This problem is typically encountered when embossing cellulose based webs. Fiber based webs, in particular, are prone to having loose fiber and stickies which readily cling to the embossing rolls. Other specific examples include webs made of natural fiber, e.g. cellulose fiber, and/or synthetic fibers, e.g. rayon fiber.

As the web is passed through the nip, the loose fiber elements and stickies in the web stick to the surface of the embossing roll. The present invention provides for the cleaning of the rolls by directing a stream of pressured air in the form of an air knife against the surface of the embossing rolls. As illustrated in FIG. 1, an air nozzle 14 directs the air against the surface of the embossing roll 12 as the embossing roll rotates. The air nozzle 14 forms the pressured air into an air knife 16. The force of the air knife 16 dislodges deposits 18 that may have stuck to the surface of the embossing roll 12.

Figure 2:
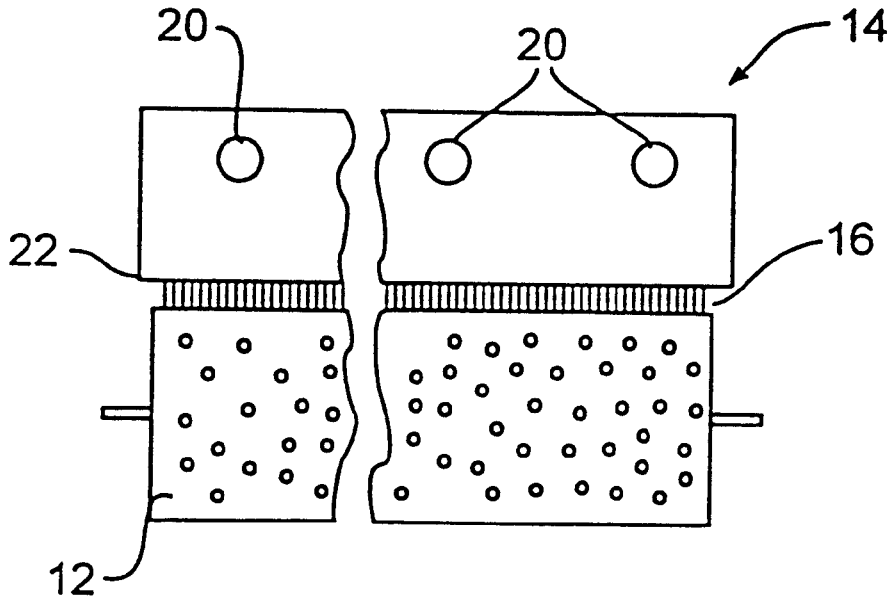
FIG. 2 is a top view of the air nozzle and an embossing roll.
Figure 3:
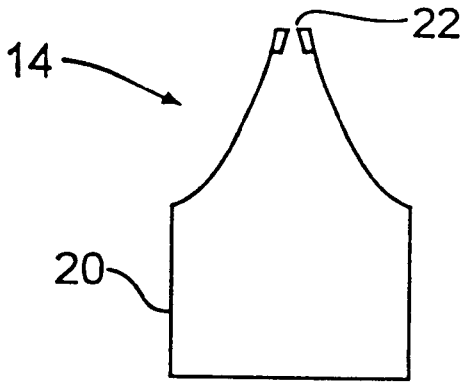
FIG. 3 is a cross section of the air nozzle.

As FIGS. 2 and 3 illustrate, a preferred embodiment of the air nozzle 14 has ⅜ inch diameter holes, spaced 6 inches apart, which act as the air inlet 20 and an elongated narrow outlet or slit 22 that extends the width of the embossing roll 12. The width of the outlet 22 is wide enough to allow the formation of an air knife capable of dislodging deposits from the surface of the embossing roll, but narrow enough to minimize the amount of air required. The width of the outlet 22 can be between 0.020 and 0.001 inches. In the preferred embodiment, the width of the outlet 22 is approximately 0.005 inches. The air nozzle is optimally located far enough from the surface of the embossing roll to minimize the possibility of deposit accumulation on the nozzle itself, but close enough to dislodge deposits from the surface of the roll. The optimum location of the air knife nozzle 14 is 0.1 to 0.25 inches from the surface of the embossing roll 12.

A source of compressed air (not shown) supplies air to the air inlets 20. The air nozzle 14 then forms the pressured air into an air knife 16 which is directed against the surface of the embossing roll 12. The air should be pressured to the point where the air knife will dislodge deposits. The required pressure can range between 100 and 1 psig. In the present embodiment, the air is pressured between 3 and 4 psig.

In another embodiment, the present invention includes a means for mixing a lubricant with the pressured air. The mixture of air and lubricant are passed through the outlet of the nozzle and are directed against the surface of the embossing roll. The lubricant coats the surface of the embossing roll to prevent the accumulation of deposits on the surface of the roll during the embossing process. A variety of means may be used to mix the lubricant with the pressured air. Airline lubricators and metering pumps are a few examples of the variety of devices which may be used.

In yet another embodiment of the invention, a solvent solution can be mixed with the lubricant in the airstream to dissolve any deposits which do stick to the embossing roll. The solvent will dissolve deposits that do stick to the surface of the embossing rolls and are not dislodged by the air knife.

There are a variety of lubricants and solvents that may be used with the present invention. In another alternative according to the present invention, a chemical that is a solvent with lubricating properties can be used. Research by the inventors has revealed a group of chemicals that work especially well. In one preferred embodiment, tri-octyldodecyl-citrate (Lambent Siltech CE 2000) will be used as the lubricant and solvent solution. This chemical is beneficial because it is extremely efficient in preventing and emulsifying sticky deposits.

There are other chemicals which may be used to accomplish the same goal. For example, another possibility is a chemical manufactured by Lambent Technologies under the trade name Fluoro Guerbet Ester 3.5. Fluoro Guerbet Ester 3.5 is also known under its chemical name as Fluoro Guerbet Citrate Ester and by its CTFA name of Dioctyldodecyl Fluoroheptyl Citrate. Other preferred lubricating materials which work well are: severely treated, low viscosity, hydrotreated paraffinic white mineral oil (Amoco Superla® DCO 55); a polydimethysiloxane silicone compound and reactive silane (Lambent Technologies Silube MT); and $C_{12-15}$ Alkyl Benzoate (Finsolv® TN made by Fintex®, Inc.).

The rate at which the lubricant and solvent solution is added to the air supply of the air knife should be minimized to prevent the waste of chemical. The addition rate of the solution may be between 0.5 g and 12 g per 3,000 $ft^2$ of paper passing through the roll. In a preferred embodiment, the lubricant and solvent solution is added to the air supply at a rate of 2.3 g per 3,000 $ft^2$ of paper. At this rate, if all of the material added to the air supply were picked up by an 18.5 lb./3000 $ft^2$ web, the web would retain only about a 0.028% concentration of chemical by weight of paper embossed.

The present invention may also be used to add other materials to the web. Any material commonly recognized in the art can be added to the air supply along with the lubricant and solvent solution. Some examples include softeners/debonders, permanent wet strength agents, temporary wet strength agents, and anti-bacterial agents. The pressured air will spray these materials onto the surface of the embossing roll. When the web makes contact with the embossing roll the web will absorb the material from the surface of the roll.

The method and apparatus of the present invention for dispersing the lubricant and solvent solution through an air knife nozzle provides several advantages over the use of spray nozzles. The present invention provides for a uniform application of the lubricant and solvent solution to the surface of the embossing roll while minimizing the rate of application. The corresponding rate of application through conventional spray type nozzles would be four to forty times greater. The uniform distribution is also important as fiber deposits will get trapped in the areas of the embossing roll having too much lubricant, while sticky deposits will stick to the areas of the surface that do not get enough of the lubricant and solvent solution. In addition, there is essentially no over spray of the lubricant and solvent solution and no need for an additional station of spray nozzles or anilox rolls. Thus, the present invention reduces operating costs and lowers the safety hazards of breathing the chemical mist and the chemical dripping on floor. Moreover, the air knife nozzle's opening is less likely to plug than spray nozzles, thereby reducing maintenance.

EXAMPLES

In the following examples, a paper web was run through an embossing configuration for 20 minutes (approximately 24,000 linear feet of web) while an air knife and different chemicals were used to keep the embossing rolls clean of deposits. In each case, the embossing rolls were coated with electroless nickel impregnated with Teflon. The following examples illustrate the results.

Example 1

An air knife, without the addition of a lubricating or solvent material, was used to clean the embossing roll. The web being embossed was made of paper that contained 50% Naheola southern softwood and 50% Naheola southern hardwood. The Naheola southern softwood is known for having much pitch and many stickies. After the 20 minutes of use there were 23 fiber or sticky plugs on the embossing roll.

Example 2

117 g of a low viscosity, light mineral oil lubricant were added to the air supply of the air knives during a 20 minute run in the same manner as Example 1. At the end of the run, there were 6 fiber or sticky plugs found on the embossing roll.

Example 3

77 g of a straight silicone compound (polydimethylsil oxane) were added to the air supply of the air knives during a 20 minute run in the same manner as Example 1. After the run was completed, there were 5 fiber or sticky plugs found on the embossing roll.

Example 4

105.4 g of Fluoro Guerbet Citrate Ester (silicone compound with solvent molecules added) were added to the air supply of the air knives during a 20 minute run in the same manner as Example 1. After completing the run, no fiber or sticky plugs were left on the embossing roll. This test was run twice to the same result.

Example 5

23 g of Fluoro Guerbet Citrate Ester were added to the air Supply of the air knives during a 20 minute run. The web being embossed was made of paper that contained 35% secondary fiber and normally contains a large amount of stickies. At the conclusion of this run, no fiber or sticky plugs were found on the embossing roll.

Example 6

37.4 g of FINSOLV® TN $C_{12-15}$ alkyl benzoate were added to the air supply of the air knives during a 20 minute run. The web being embossed was made of paper that contained 35% secondary fiber and normally contains a large amount of stickies. At the conclusion of this run, no fiber or sticky plugs were found on the embossing roll.

Example 7

30.4 g of tri-octyldodecyl-citrate were added to the air supply of the air knives during a 20 minute run. The web being embossed was made of paper that contained 35% secondary fiber and normally contains a large amount of stickies. At the conclusion of this run, no fiber or sticky plugs were found on the embossing roll.

Example 8

27.7 g of Silube DG-3800 (Octyldodecyl-octyldecanate) were added to the air supply of the air knives during a 20 minute run. The web being embossed was made of paper that contained 35% secondary fiber and normally contains a large amount of stickies. At the conclusion of this run, 1 fiber or sticky plug was found on the embossing roll.

SUMMARY OF EXAMPLES

| | Web Material | Material Used | Amt. of Matl. (g) | Nbr. of Deposits |
|---|---|---|---|---|
| 1 | paper-50% Naheola southern softwood, 50% Naheola southern hardwood | none | n/a | 23 |
| 2 | same as 1 | low viscosity, light mineral oil lubricant | 117 | 6 |
| 3 | same as 1 | polydimethylsil-oxane | 77 | 5 |
| 4 | same as 1 | Fluoro Guerbet Citrate Ester | 105.4 | 0 |
| 5 | paper with 35% secondary fiber | Fluoro Guerbet Citrate Ester | 23 | 0 |
| 6 | same as 5 | FINSOLV ® TN $C_{12-15}$ alkyl benzoate | 37.4 | 0 |
| 7 | same as 5 | tri-octyldodecyl-citrate | 30.4 | 0 |
| 8 | same as 5 (Octyldecyl- | Silube DG-3800 octyldecanate) | 27.7 | 1 |

It will be apparent to those skilled in the art that various modifications and variations can be made in the method of embossing the web and the construction of the cleaning apparatus without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed:

1. An embossing system, comprising:

an embossing roll having a relieved pattern surface; and a cleaning apparatus configured to prevent the accumulation of deposits on the relieved pattern surface of the embossing roll during an embossing process, the cleaning apparatus comprising:

a nozzle having an air inlet and an elongated narrow outlet, the outlet extending an embossing width of the embossing roll; and a source of compressed air connected to the air inlet of the nozzle, the outlet of the nozzle directing the pressured air as an air knife against the surface of the embossing roll.

2. The embossing system of claim 1, wherein the embossing roll is plated with electroless nickel.

3. The embossing system of claim 1, wherein the relieved pattern surface of the embossing roll is impregnated with a thermoplastic resin having non-stick characteristics.

4. The embossing system of claim 1, wherein the relieved pattern surface of the embossing roll is plated with electroless nickel impregnated with a thermoplastic resin having non-stick characteristics.

5. The embossing system of claim 1, wherein the embossing roll is rigid.

6. The embossing system of claim 1, wherein the embossing roll is resilient.

7. The embossing system of claim 1 further comprising:

means for mixing a lubricant with the air, wherein the mixture of lubricant and pressured air is passed through the outlet of the nozzle and is directed against the surface of the embossing roll to coat the surface of the embossing roll with the lubricant to prevent the accumulation of deposits on the surface of the embossing roll during the embossing process.

8. The embossing system of claim 1 further comprising:

means for mixing a solvent with the pressured air, wherein the mixture of solvent and pressured air is passed through the outlet of the nozzle and is directed against the surface of the embossing roll to coat the surface of the embossing roll with the solvent to dissolve deposits stuck on the surface of the embossing roll during the embossing process.

9. The embossing system of claim 1, further comprising:

means for mixing a lubricant having solvent properties with the pressured air, wherein the mixture of the lubricant having solvent properties and pressured air is passed through the outlet of the nozzle and is directed against the surface of the embossing roll.

10. A system for imparting a pattern on a web, comprising:

a relieved-pattern roll having a surface; and a cleaning apparatus configured to prevent the accumulation of deposits on the surface of the relieved-pattern roll, the cleaning apparatus comprising:

a nozzle having an air inlet and an elongated narrow outlet, the outlet extending along the width of the relieved-pattern roll; and a source of compressed air connected to the air inlet of the nozzle, the outlet of the nozzle directing the pressured air as an air knife against the surface of the relieved-pattern roll.

11. The system of claim 10, wherein the relieved-pattern roll is plated with electroless nickel.

12. The system of claim 10, wherein the surface of the relieved-pattern roll is impregnated with a thermoplastic resin having non-stick characteristics.

13. The system of claim 10, wherein the surface of the relieved-pattern roll is plated with electroless nickel impregnated with a thermoplastic resin having non-stick characteristics.

14. The system of claim 10, further comprising:

means for mixing a lubricant with the air, wherein the mixture of lubricant and pressured air is passed through the outlet of the nozzle and is directed against the surface of the relieved-pattern roll to coat the surface of the relieved-pattern roll with the lubricant to prevent the accumulation of deposits on the surface of the relieved-pattern roll.

15. The system of claim 10 further comprising:

means for mixing a solvent with the pressured air, wherein the mixture of solvent and pressured air is passed through the outlet of the nozzle and is directed against surface of the relieved-pattern roll to coat the surface of the relieved-pattern roll with the solvent to dissolve deposits stuck on surface of the relieved-pattern roll.

16. The system of claim 10, further comprising:

means for mixing a lubricant having solvent properties with the pressured air, wherein the mixture of the lubricant having solvent properties and pressured air is passed through the outlet of the nozzle and is directed against the surface of the relieved-pattern roll.

* * * * *